US011228144B2

(12) United States Patent
Kim et al.

(10) Patent No.: US 11,228,144 B2
(45) Date of Patent: Jan. 18, 2022

(54) ELECTRICAL CONNECTOR WITH LOCK LEVER

(71) Applicant: J.S.T. Mfg. Co., Ltd., Tokyo (JP)

(72) Inventors: Sung-Min Kim, Gyeonggi-do (KR); Kang-Suk Noh, Gyeonggi-do (KR)

(73) Assignee: J.S.T. MFG. CO., LTD., Osaka (JP)

( * ) Notice: Subject to any disclaimer, the term of this patent is extended or adjusted under 35 U.S.C. 154(b) by 0 days.

(21) Appl. No.: 17/029,971

(22) Filed: Sep. 23, 2020

(65) Prior Publication Data

US 2021/0091509 A1 Mar. 25, 2021

(30) Foreign Application Priority Data

Sep. 25, 2019 (JP) ..... JP2019-174464

(51) Int. Cl.
*H01R 13/639* (2006.01)
*H01R 13/629* (2006.01)

(52) U.S. Cl.
CPC . *H01R 13/62955* (2013.01); *H01R 13/62938* (2013.01); *H01R 13/639* (2013.01)

(58) Field of Classification Search
CPC ..... H01R 13/62955; H01R 13/62938; H01R 13/639
See application file for complete search history.

(56) References Cited

U.S. PATENT DOCUMENTS 7,686,631 B1 * 3/2010 Eow ..... H01R 13/62955 439/157
2014/0134862 A1 * 5/2014 Itou ..... H01R 13/516 439/157
2017/0373437 A1 * 12/2017 Gang ..... H01R 13/62955
2019/0123485 A1 * 4/2019 Probert ..... H01R 13/62938

FOREIGN PATENT DOCUMENTS

JP H05-090850 U 12/1993

* cited by examiner

*Primary Examiner* — Tho D Ta
(74) *Attorney, Agent, or Firm* — Kratz, Quintos & Hanson, LLP

(57) ABSTRACT

A plug as an electrical connector according to the present disclosure includes a box-shaped housing and a lock lever having an arm in such a manner that a base end of the arm is rotatable, and the lock lever is configured to pull the mating housing inside the box-shaped housing. On a side face of the box-shaped housing, a projection is provided which can be hidden from the side face thereof. A recess is provided in an intermediate portion of the arm of the lock lever, and the projection can be introduced and the rotation of the lock lever in the one direction can be prevented. The recess includes a bottom wall (first inner wall) and a side wall (second inner wall) formed therein which can be pressed by the projection by a rotational force of the lock lever in one direction being divided.

9 Claims, 12 Drawing Sheets

ELECTRICAL CONNECTOR WITH LOCK LEVER

This application is based on and claims the benefit of priority from Japanese Patent Application No. 2019-174464, filed on 25 Sep. 2019, the content of which is incorporated herein by reference.

BACKGROUND OF THE INVENTION

Field of the Invention

The present invention relates to an electrical connector. In particular, the present invention relates to the structure of an electrical connector equipped with a lock lever for maintaining coupling with a mating connector, and having a pre-lock mechanism in which the lock lever is not easily moved while uncoupled with a mating connector.

Related Art

For example, many wire harnesses (wire bundles with connectors) are installed inside of automobiles. It has been known that the electrical connectors of wire harnesses used in automobiles, etc. have a large number of connection terminals.

Such electrical connectors having a large number of connection terminals have increased coupling force with the mating connectors. Therefore, an electrical connector with a lock lever utilizing the principle leverage has been disclosed (e.g., see Japanese Unexamined Utility Model Application, Publication No. H05-090850).

In the electrical connector disclosed in Japanese Unexamined Utility Model Application, Publication No. H05-090850, a box-shaped female connector housing which is open at one face is provided with an actuating lever (also referred to as a portal lock lever) for securing fitting with a male connector housing.

When the actuating lever is not functioning, the actuating lever is locked by an outwardly projecting locking portion at the open edge of the female connector housing. Thus, in a state in which the connectors are not connected to each other, the actuating lever is configured so as not to move freely.

However, the impact to the electrical connectors during conveyance or when dropped, applies a large load to the locking portion that locks the actuating lever. Due to this, the actuating lever may be unlocked from the locking portion and move. In particular, with a small-scaled electrical connector, it is difficult to increase the strength by shape modification by increasing the external form of the locking portion.

SUMMARY OF THE INVENTION

The present invention has been made in view of the above situation, and an object thereof is to provide an electrical connector having a pre-lock mechanism whereby a lock lever is not easily moved while uncoupled with a mating connector.

The present disclosure relates to an electrical connector with a cantilevered lock lever for maintaining coupling to a mating connector. A projection that can be hidden from an outer face of the mating housing is provided to the electrical connector. A recess which can introduce the projection in the outer circumferential direction is formed in an intermediate portion of the lock lever. In a state in which the rotation of the lock lever in one direction is prevented by the projection, the recess of the lock lever is configured to be pressed by the projection in the two directions in which the rotational force of the lock lever in the one direction are divided.

In this way, by providing the recess in the lock lever, and devising the shape of the recess, a configuration in which the lock lever cannot be easily moved while uncoupled to the mating connector is achieved.

The present inventors have thereby arrived at devising the following novel electrical connector based on the above.

(1) An electrical connector according to the present disclosure relates to an electrical connector configured to be detachably connected to a mating connector, the electrical connector including: a box-shaped housing having an opening on one face through which a mating housing of the mating connector can be introduced inside; a lock lever including at least one arm that is coupled to at least one side face of the box-shaped housing in a cantilevered manner and in such a manner that a base end of the arm is rotatable, the lock lever configured to pull the mating housing inside the box-shaped housing; and a projection that can be hidden from a side face of the box-shaped housing, the projection configured to project from at least one side face of the box-shaped housing in a state in which the mating housing is not introduced inside the box-shaped housing, and configured to be hidden from the at least one side face of the box-shaped housing in a state in which the mating housing is introduced inside the box-shaped housing, in which the lock lever has a rectangular recess in an intermediate portion of the arm, and to which the projection can be introduced, the recess includes a first inner wall and a second inner wall formed therein which can be pressed by the projection by a rotational force of the lock lever in one direction being divided, and in a state in which the projection projects from the one side face of the box-shaped housing, the rotation of the lock lever in the one direction is prevented.

(2) It is more preferable that the lock lever is configured as a portal lock lever in which the arms are disposed opposing each other and tip ends of the arms are coupled by a grip, and the box-shaped housing has a pair of coupling portions that rotatably holds base ends of the arms on both side faces of the box-shaped housing.

(3) The electrical connector according to the present disclosure further includes a cable cover that covers an opposite side of the one face of the box-shaped housing, in which the lock lever includes a lance at the grip, and the cable cover includes a locking piece that can be locked with the lance of the grip at the top of the cable cover.

(4) It is preferable that the lock lever includes a disk portion that projects toward an inner wall side of the box-shaped housing at, the base end of the arm, and a cam groove provided at the disk portion, the mating housing includes a locking projection that projects from an outer wall of the mating housing and can approach the cam groove of the disk portion, and the cam groove of the disk portion is configured to guide the mating housing in such a manner being able to pull the mating housing to the box-shaped housing, when rotating the lock lever in one direction from a state in which the locking projection is introduced from an inlet of the cam groove.

DETAILED DESCRIPTION OF THE INVENTION

Hereinafter, a description will be given of an embodiment of the present invention with reference to the drawings.

Configuration of Electrical Connector

First, the configuration of an electrical connector according to an embodiment of the present invention will be described.

Overall Configuration

Figure 1:
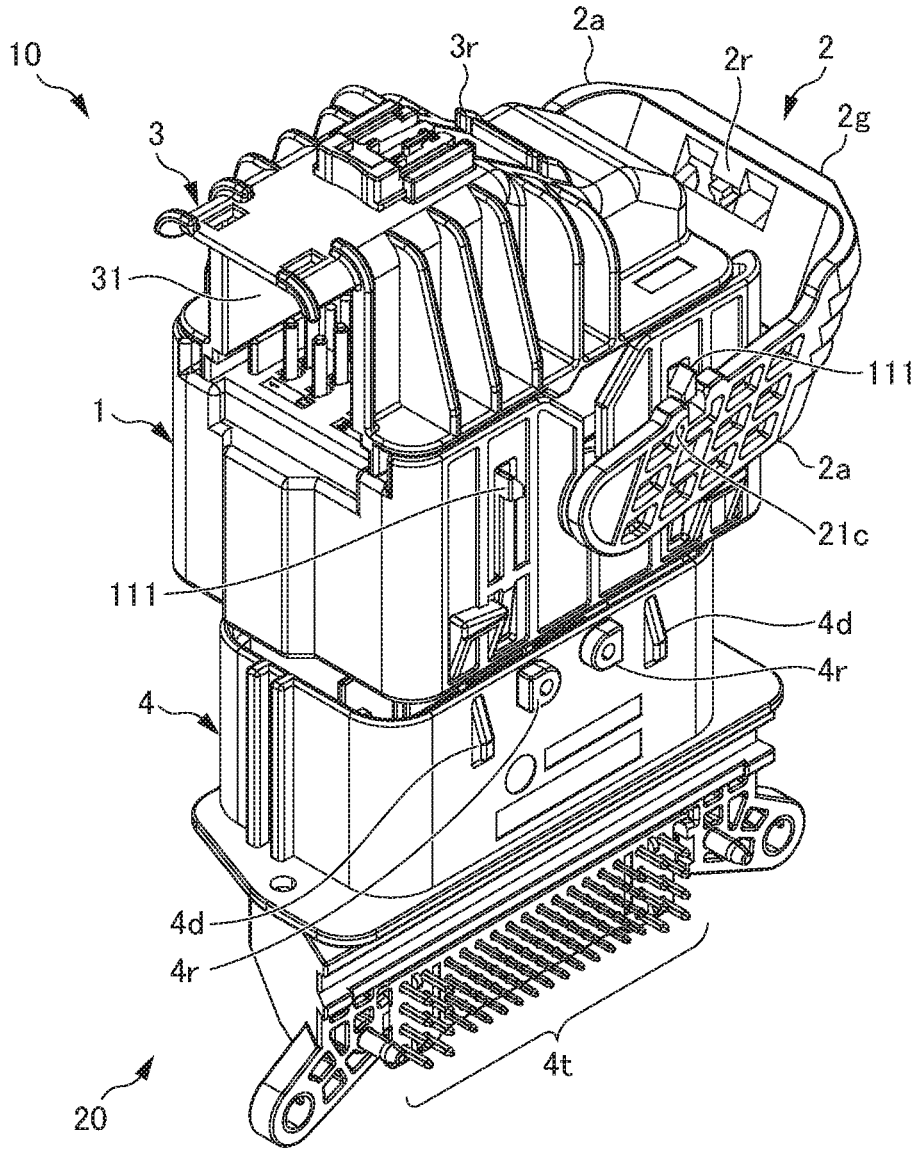
FIG. 1 is a perspective view showing the configuration of an electrical connector according to an embodiment of the present invention, and shows an aspect in which an electrical connector faces a mating connector in a state uncoupled to each other.
Figure 2:
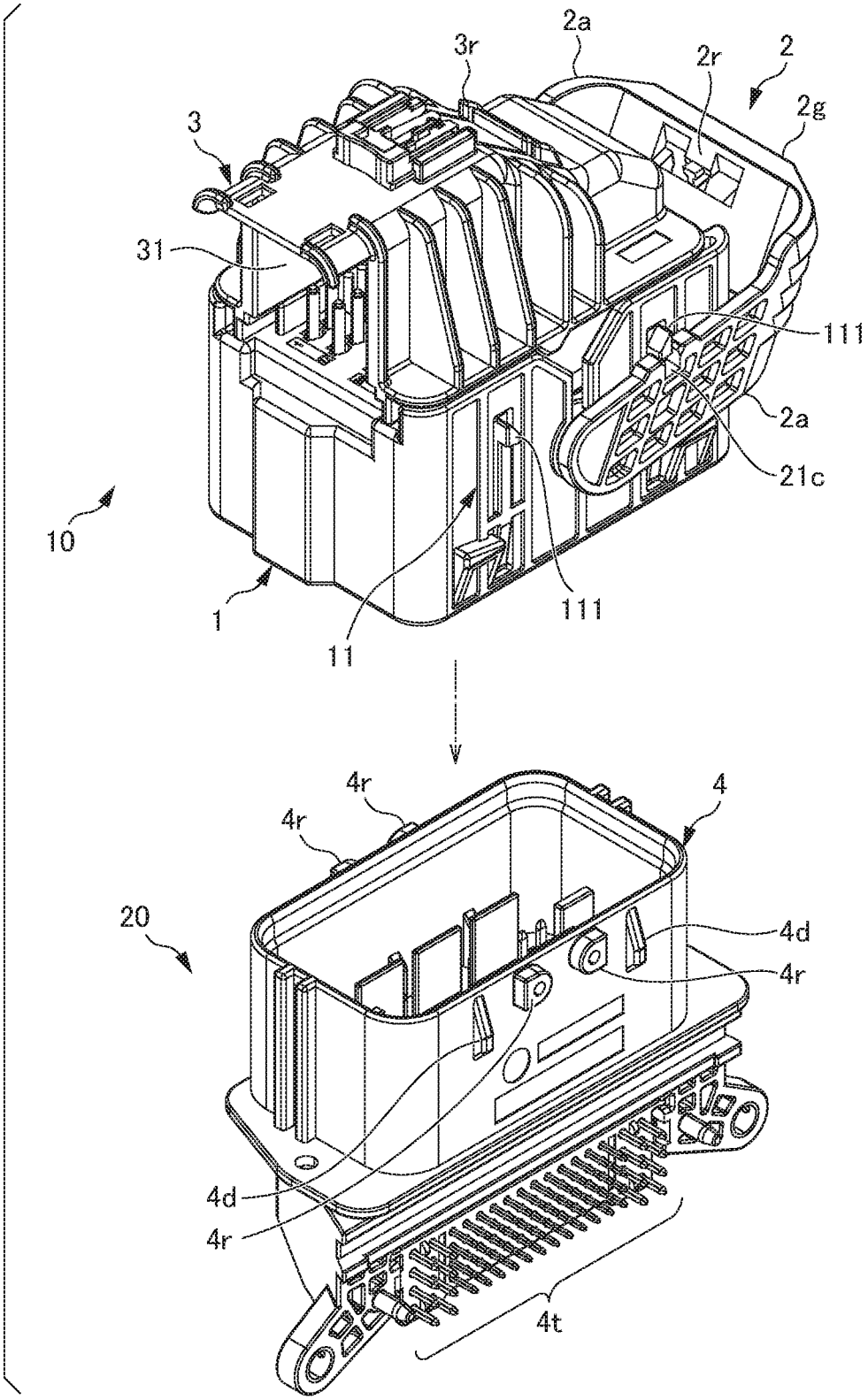
FIG. 2 is a perspective view showing the configuration of an electrical connector according to the embodiment, and shows an aspect in which the mating connector is opposingly disposed to be separated when compared with FIG. 1.
Figure 3:
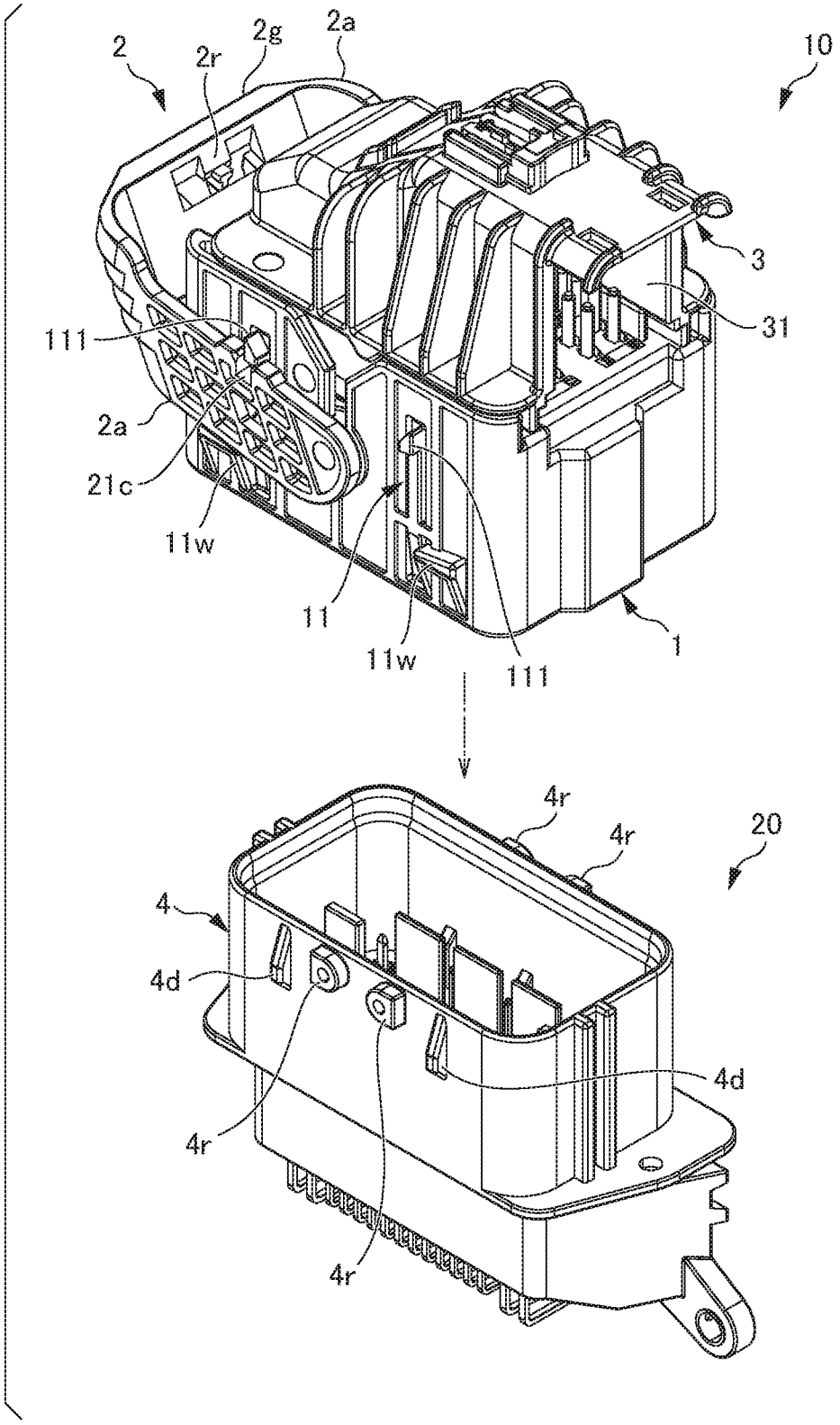
FIG. 3 is a perspective view showing the configuration of an electrical connector according to the embodiment, and shows an aspect viewed from the opposite side of the state in FIG. 2.

With reference to FIGS. 1 to 3, an electrical connector (hereinafter, also referred to as a plug) 10 according to an embodiment of the present invention can be removably connected to a mating connector (hereinafter, also referred to as a receptacle) 20.

The plug 10 includes a box-shaped housing 1, a lock lever 2, and a cable cover 3. The housing 1 is also referred to as a plug housing. The housing 1 has an opening on one face. This opening allows a housing 4 of the receptacle 20 to be introduced thereinto (see FIG. 6). Furthermore, a plurality of first contacts it is arranged inside the housing 1. Inside of the housing 4 of the receptacle 20, second contacts 4*t* which can be connected to the first contacts it are arranged.

With reference to FIGS. 1 to 5, the lock lever 2 includes an arm 2*a* and a grip 2*g*. The arm 2*a* is coupled to at least one side face of the housing 1 in a cantilevered manner and in such a manner that a base end of the arm 2*a* is rotatable. By rotating the lock lever 2 in one direction, it is possible to pull the housing 4 of the receptacle 20 inside the housing 1. The expression "possible to pull" encompasses, more specifically, making it possible to strengthen or ensure the engagement (connection) between the housing 1 and the housing 4.

With reference to FIGS. 1 to 9, the plug 10 is provided with a projection 111 which can be hidden from at least one side face of the housing 1. In a state in which the housing 4 of the receptacle 20 is not introduced into the housing 1, the projection 111 is in a state projecting from at least one side face of the housing 1 (see FIGS. 1 to 3). On the other hand, in a state in which the housing 4 of the receptacle 20 is introduced into the housing 1, the projection 111 can be established in a state hidden without projecting from at least one side face of the housing 1 (see FIG. 6).

Figure 4:
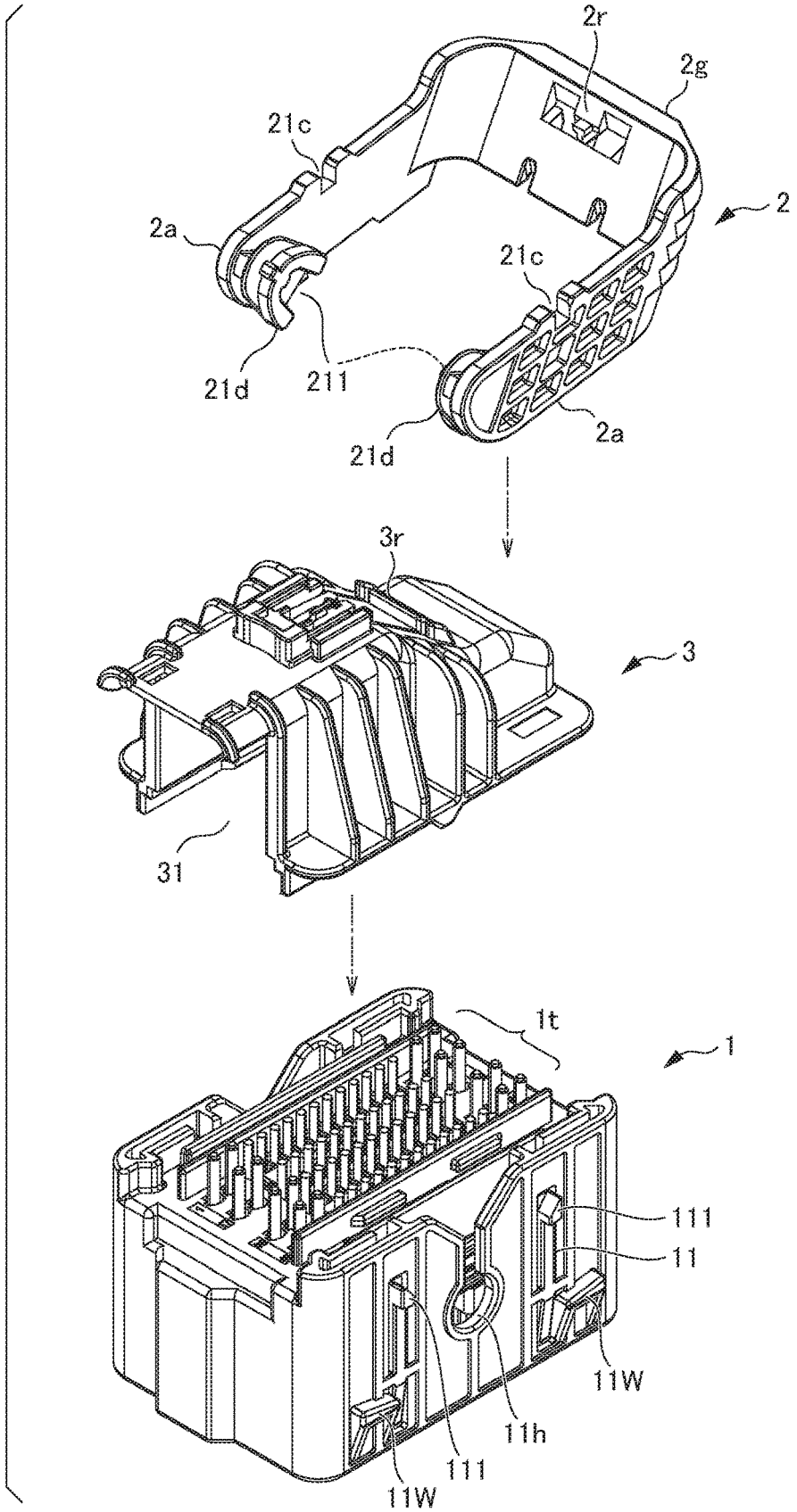
FIG. 4 is a perspective exploded view showing the configuration of an electrical connector according to the embodiment.

With reference to FIG. 4, the lock lever 2 has a rectangular recess 21*c* formed in the intermediate portion of the arm 2*a*. It is possible to introduce the projection 111 into the recess 21*c* (see FIGS. 1 to 4). The recess 21*c* includes a bottom wall (first inner wall) and one side wall (second inner wall) formed therein which are pressed by the projection 111 from two directions A and B in which the rotational force of the lock lever 2 in one direction D1 are divided (see FIG. 10C).

With reference to FIG. 10D, in a state in which the projection 111 projects from one side face of the housing 1, it is possible to prevent the rotation of the lock lever 2 in the one direction D1.

With reference to FIGS. 1 to 9, the plug 10 according to the embodiment is provided with the cantilever-shaped lock lever 2 and the projection 111 which can be hidden from the outer surface of the housing 1, and the intermediate portion of the lock lever 2 has the recess 21*c* formed therein through which the projection 111 formed in the housing 1 can be introduced from the outer circumferential direction. With such a configuration, in a state in which the rotation of the lock lever 2 in the one direction D1 is blocked by the projection 111, in the recess 21*c*, the projection 111 is pressed from the two directions A and B the rotational force of the lock lever 2 in the one direction D1 is divided. As a result, an effect is achieved in which the lock lever 2 is not easily moved while uncoupled with the receptacle 20.

Configuration of Housing

Next, a description will be given of the configuration of the housing 1 according to the embodiment. With reference to FIGS. 1 to 9, the housing 1 is preferably composed of a synthetic resin having an insulating property. By molding a synthetic resin having an insulating property, the box-shaped housing (plug housing) 1 is obtained which is open from one end toward the other end.

Figure 5:
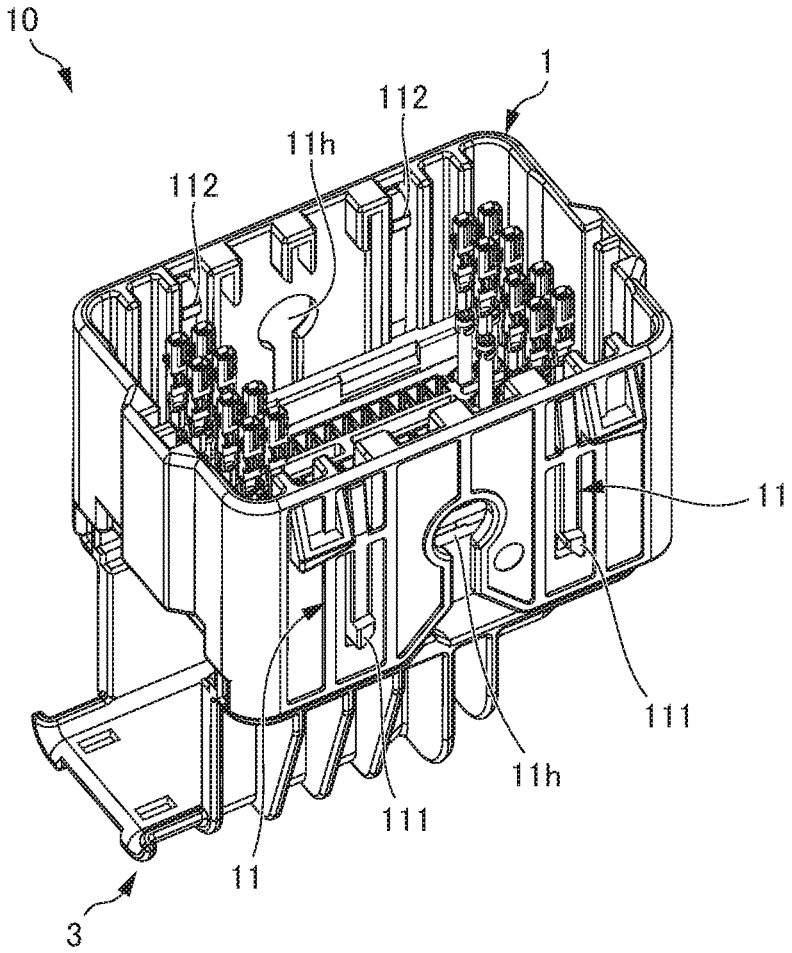
FIG. 5 is a perspective view showing the configuration of an electrical connector according to the embodiment, and shows an aspect viewing the electrical connector from the opening side by omitting illustration of a lock lever.

With reference to FIGS. 4 and 5, a pair of swingable lock arms 11, 11 are formed on one side face and the other side face of the housing 1, respectively. A fulcrum of the intermediate portion of each lock arm 11 is coupled to a side face of the housing 1 via a pair of twistable torsion arms. The lock arm 11 has a projection 111 at one end, and has a projection 112 at the other end. The projection 111 is formed so as to project outward from the side face of the housing 1, and the projection 112 is formed so as to project inward from the side face of the housing 1.

With reference to FIGS. 1 to 9, in a normal state in which the housing 4 of the receptacle 20 is not introduced into the interior of the housing 1, the projection 111 projects in directions opposite to each other from both side faces of the housing 1. The projection 111 has a height that exceeds the side face of the housing 1. With such a configuration, in the normal state of the housing 1, the rotation of the lock lever 2 in the one direction D1 is prevented by the pair of projections 111 and 111 in the opposite directions.

With reference to FIG. 3 or FIG. 4, a pair of stop walls 11*w* and 11*w* are respectively formed on both side faces of the housing 1. The stop wall 11*w* is provided to prevent the lock lever 2 from rotating in the other direction.

Figure 6:
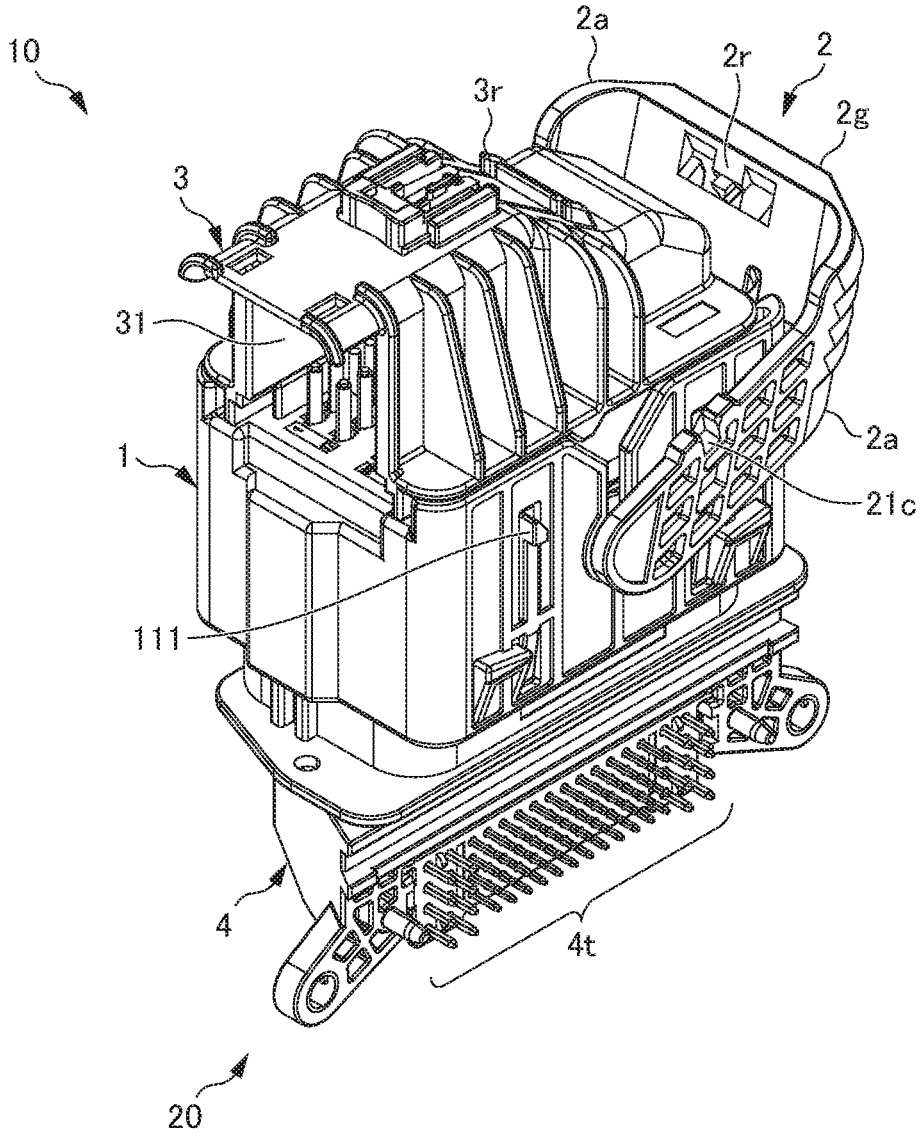
FIG. 6 is a perspective view showing the configuration of an electrical connector according to the embodiment, and shows an aspect before coupling of the mating connector.

With reference to FIG. 6, in a state in which the housing 4 of the receptacle 20 is introduced into the interior of the housing 1, the pair of projections 112 and 112 is pushed by a pair of projections 4*d* and 4*d* formed on the side face of the housing 4. With such a configuration, by the torsion arm connected to the fulcrum being deformed, the pair of lock arms 11 and 11 can be tilted. At this time, each of the projections 111 can be hidden from both side faces of the housing 1. As described above, the plug 10 has the lock arm 11 of seesaw structure.

With reference to FIG. 5, shaft holes and 11*h* are provided as a pair of coupling portions on both side faces of the housing 1. The base ends of the pair of arms 2*a* and 2*a* can be introduced to these shaft holes 11*h* and 11*h* in the axial direction (see FIG. 4). With such a configuration, the housing 1 can rotatably hold the base ends of the pair of arms 2*a* and 2*a* (see FIGS. 1 to 3).

Configuration of Cable Cover

Next, a description will be given of the configuration of the cable cover 3 according to the embodiment. With reference to FIGS. 1 to 4, the cable cover 3 covers the opposite side of one surface of the housing 1. The cable cover 3 has a lead-out opening 31 through which cables (not shown) can be led out.

With reference to FIG. 4, the first contacts 1*t* appearing on the other face of the housing 1 are connected to the end of a wire (not shown), and a cable made by bundling a plurality of wires (not shown) can be led out from the lead-out opening 31. In the state shown in FIG. 1 or FIG. 2, it is configured so that the cable (not shown) can be led out from the left side of the cable cover 3. As another aspect of the state shown in FIG. 1 or FIG. 2, it is possible to attach the cable cover 3 in an inverted manner to the housing 1. In this way, it can be configured so that the cable (not shown) can be led out from the right side of the cable cover 3.

Configuration of Lock Lever

Next, a description will be given of the configuration of the lock lever 2 according to the embodiment. With reference to FIGS. 1 to 4, the lock lever 2 is composed of a pair of strip-shaped arms 2*a* and 2*a* and the grip 2*g*. The pair of arms 2*a* and 2*a* are arranged in opposition to each other (see FIG. 4). Tip ends of the pair of arms 2*a* and 2*a* with respect to the base ends are coupled by the grip 2*g*. The housing 1 is introduced from both side faces thereof between the pair of arms 2*a* and 2*a*. With such a configuration, the lock lever 2 is configured in a portal shape.

Figure 7:
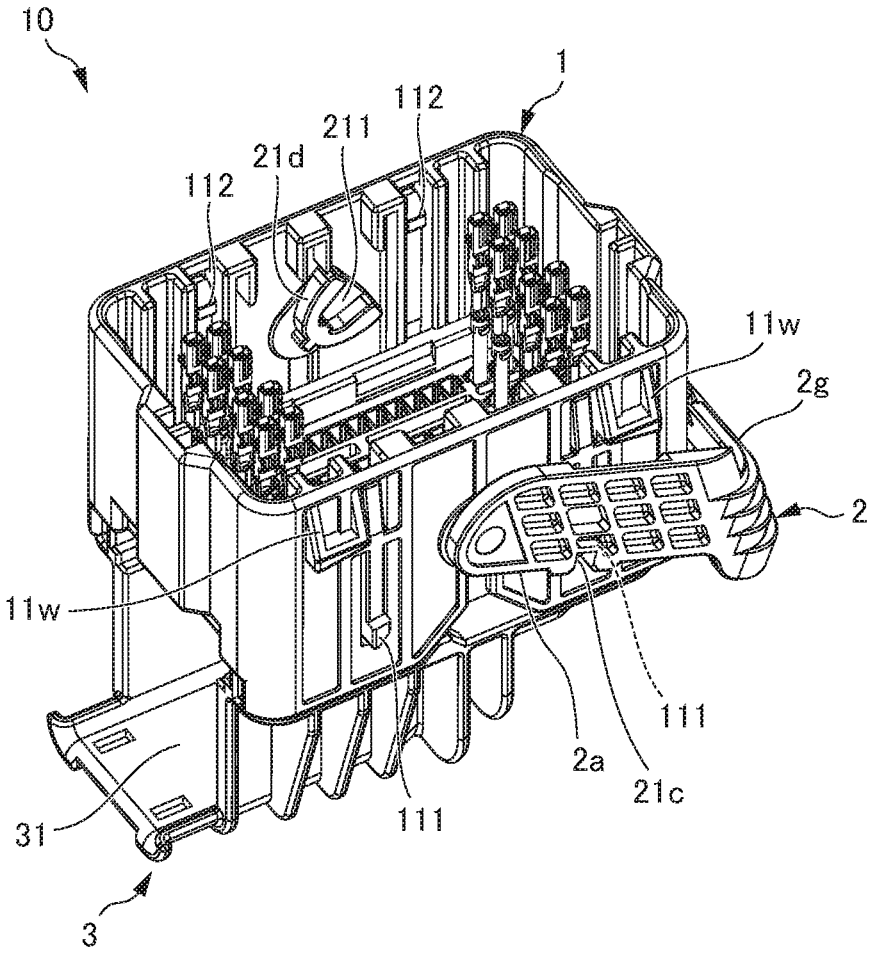
FIG. 7 is a perspective view showing the configuration of an electrical connector according to the embodiment, and shows an aspect viewing the electrical connector from the opening side by omitting illustration of the lock lever.
Figure 8:
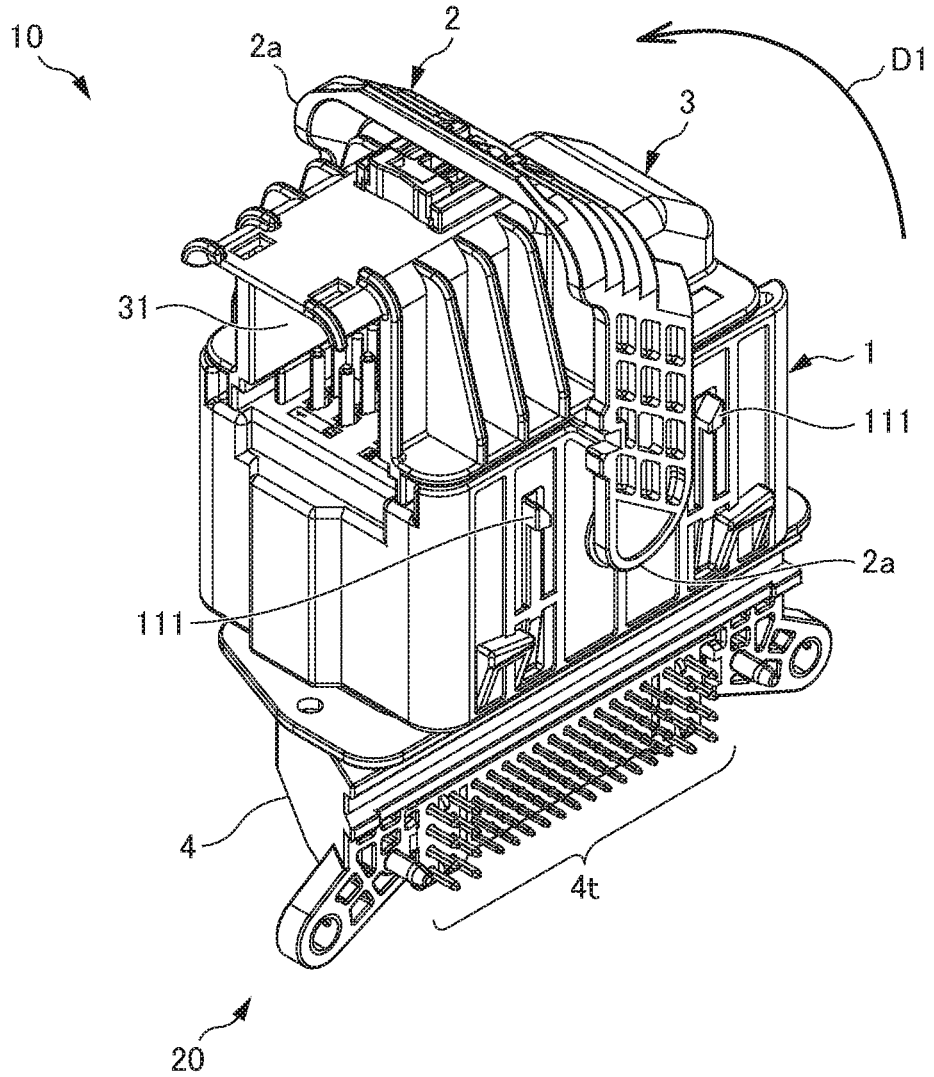
FIG. 8 is a perspective view showing the configuration of an electrical connector according to the embodiment, and shows an aspect in which the lock lever is rotated in one direction so that the electrical connector is coupled to the mating connector.
Figure 9:
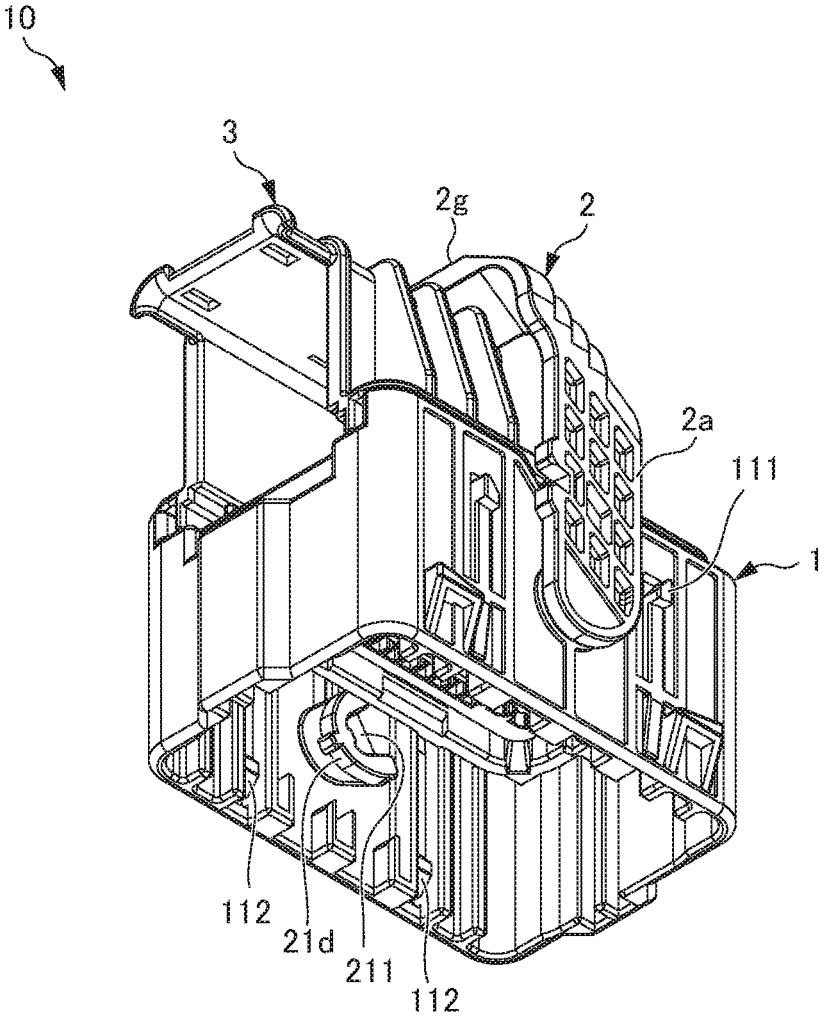
FIG. 9 is a perspective view showing the configuration of an electrical connector according to the embodiment, and shows an aspect viewing, from an opening side of the housing, a state of coupling the mating connector (not shown) by rotating the lock lever in one direction.

With reference to FIG. 4 or FIG. 7, a disk portion 21*d* is formed at the base end of the arm 2*a* of the lock lever 2. A pair of disk portions 21*d* and 21*d* projects toward the inner wall side of the housing 1, and the respective disk portions 21*d* are provided with a cam groove 211.

On the other hand, referring to FIGS. 1 to 3, the housing 4 includes a pair of locking projections 4*r* and 4*r* projecting from the outer wall thereof. In the pair of locking projections 4*r* and 4*r*, the side faces that face each other are each a cylindrical side face, and the other side faces are each a prismatic side face. When the housing 4 is introduced to the inside of the housing 1, the locking projection 4*r* can be made to approach the disk portion 21*d* and introduced to the inlet of the cam groove 211.

With reference to FIG. 1 or 4 and 7, when the lock lever 2 is rotated in the one direction D1 in a state in which the locking projection 4*r* is introduced from the inlet of the cam groove 211, it is possible for the cam groove 211 to guide the housing 4 in such a manner pulling the housing 4 to inside the housing 1.

With reference to FIG. 1 or 3 and 4, in the lock lever 2, a lance 2*r* is provided at the center of the grip 2*g*. On the other hand, with reference to FIG. 1 or FIG. 2, a locking piece 3*r* which can be engaged with the lance 2*r* of the grip 2*g* is provided at the top of the cable cover 3.

By rotating the lock lever 2 approximately 90 degrees in the one direction D1 in the state shown FIG. 1 (see FIG. 8), the lance 2*r* can be engaged with the locking piece 3*r*. Furthermore, the state in which the plug 10 is connected to the receptacle 20 can be maintained.

With reference to FIGS. 1 to 9, an example of the plug 10 according to the embodiment is described in which the rotation of the lock lever 2 is prevented by one projection 111. However, in a case in which the cable cover 3 is attached to the illustrated housing 1 in an inverted manner, it is possible to attach the lock lever 2 to the illustrated housing 1 in an inverted manner.

Operation of Electrical Connector

Next, the operation and effect of the plug 10 according to the embodiment will be described.

Figure 10C:
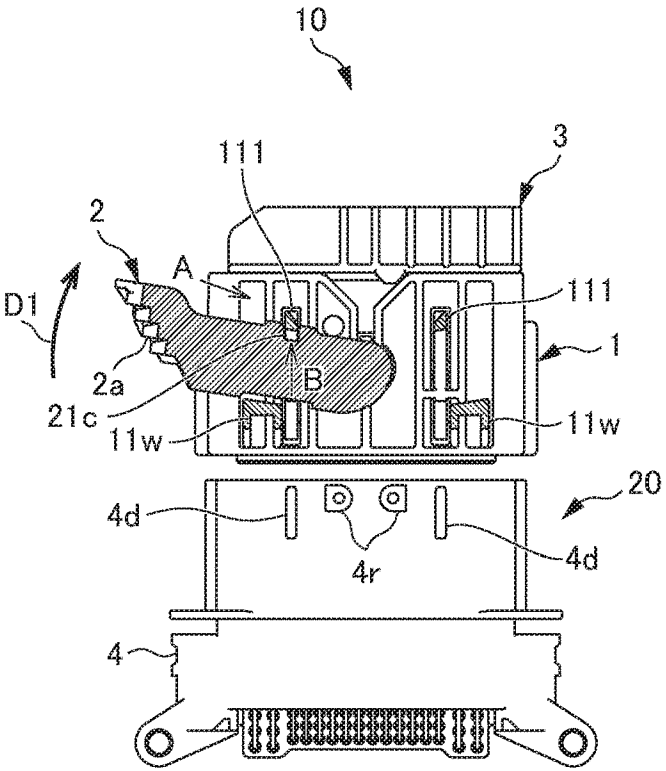
FIGS. 10A to 10C each show an aspect before the electrical connector according to the embodiment couples with the mating connector, FIG. 10A showing a plan view of the electrical connector, FIG. 10B showing a right side view of the electrical connector, and FIG. 10C showing a cross-sectional view of FIG. 10B viewed along X-X arrow.
Figure 10B:
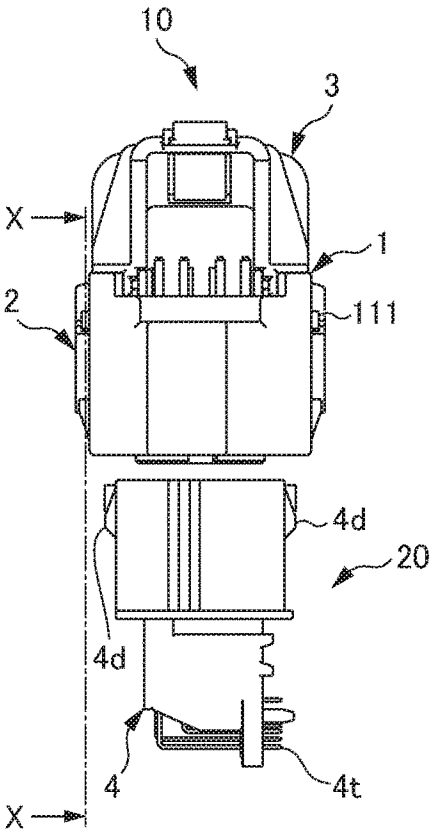
Figure 10A:
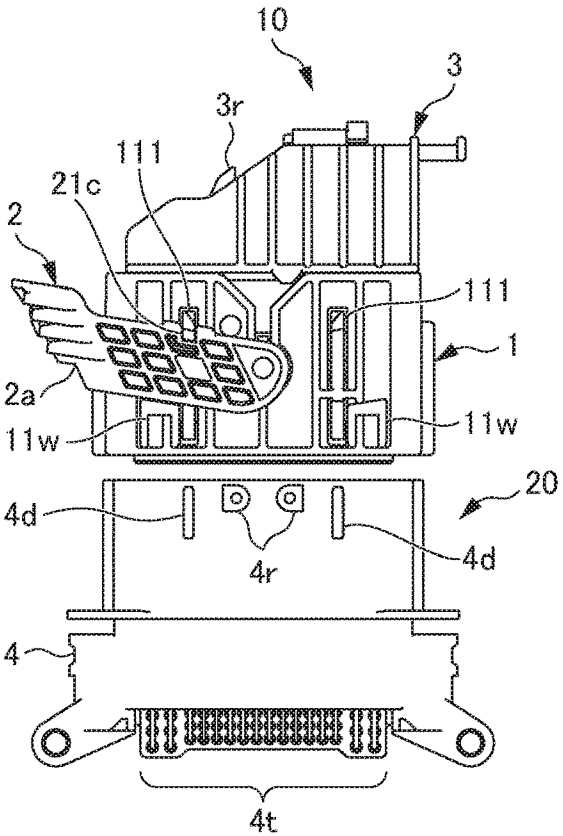

First, FIGS. 10A to 10C will be referenced. In a case in which a force is applied which causes the lock lever 2 to rotate in the one direction D1 (see FIG. 10C) in a state before the plug 10 is coupled to the receptacle 20, the projection 111 which projects from at least one side face of the housing 1 prevents the lock lever 2 from rotating in the one direction D1.

In the state shown in FIG. 10C, the projection 111 is introduced to the recess 21*c* of the lock lever 2 (see FIG. 4). The recess 21*c* includes the bottom wall (the first inner wall) and the one side wall (the second inner wall) formed therein which press the projection 111 from the two directions A and B in which the rotational force of the lock lever 2 in the one direction D1 is divided. With such a configuration, an effect is exerted whereby the position of the lock lever 2 in the plug 10 is fixed while uncoupled with the receptacle 20, and thus the lock lever 2 cannot be easily moved.

Figure 11C:
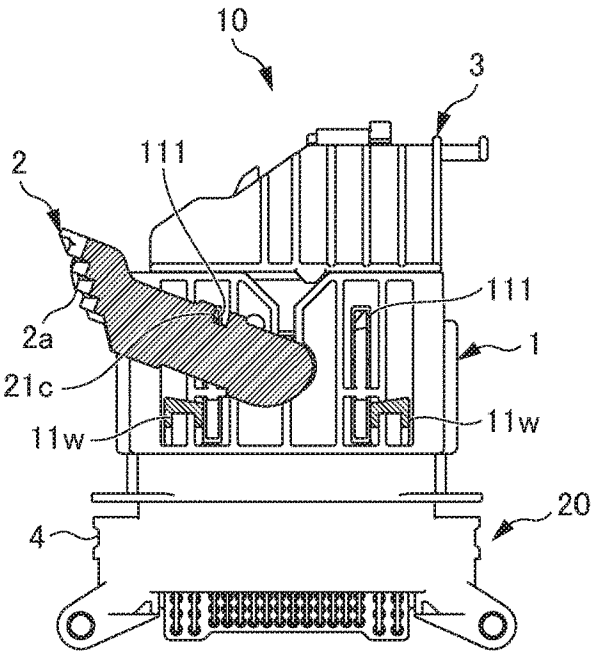
FIGS. 11A to 11C each show an aspect of the electrical connector according to the embodiment coupling with the mating connector, FIG. 11A showing a plan view of the electrical connector, FIG. 11B showing a right side view of the electrical connector, and FIG. 11C showing a cross-sectional view of FIG. 11B viewed along X-X arrow.
Figure 11B:
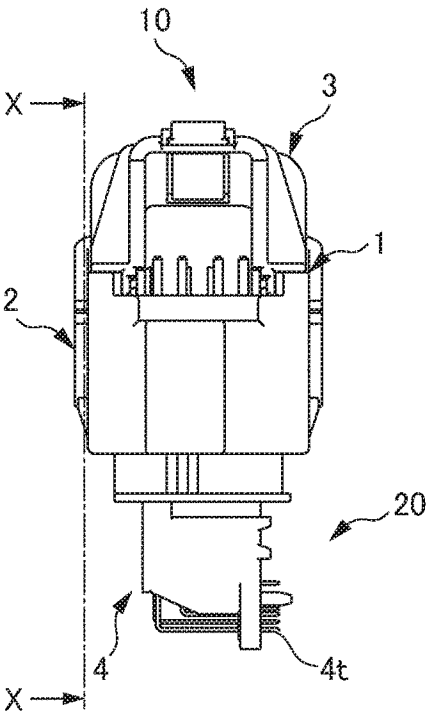
Figure 11A:
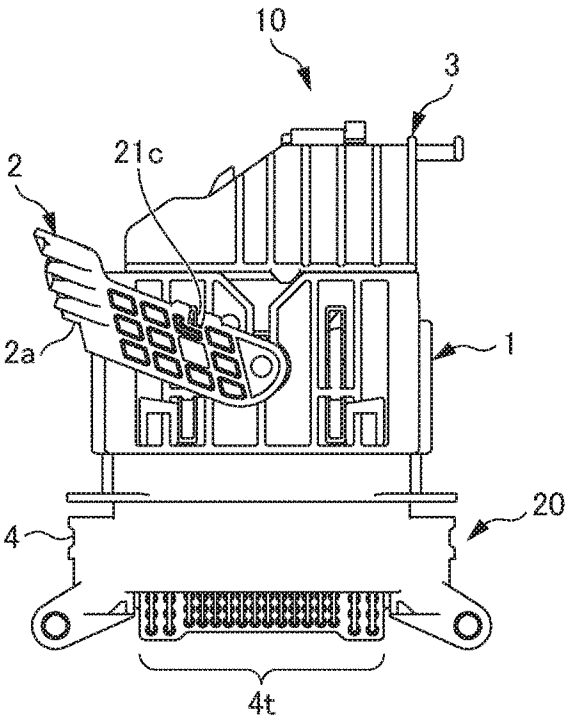

FIGS. 11A to 11C will be referenced. In a state in which the plug 10 is coupled to the receptacle 20, the pair of projections 111 and 111 is hidden from both side faces of the housing 1. As described above, the pressing of the projections 112 and 112 by the projections 4*d* and 4*d* is involved with this state. Thus, the lock lever 2 is allowed to rotate in the one direction D1 with respect to the housing 1.

Figure 12C:
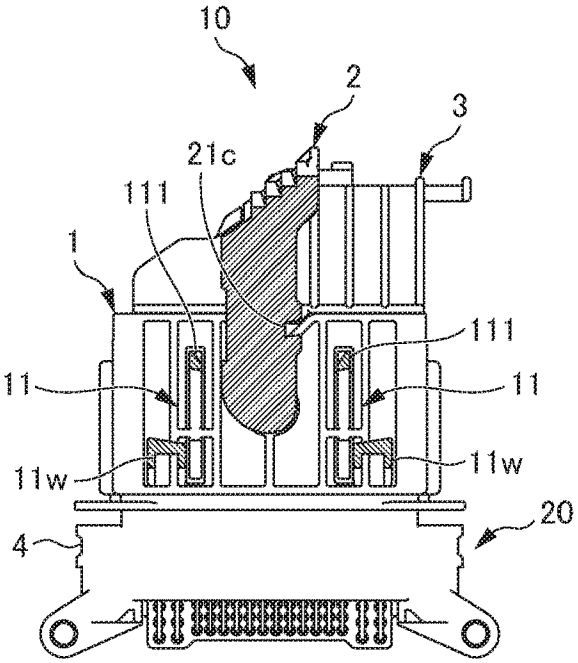
FIGS. 12A to 12C each show a state in which the lock lever is rotated in one direction so that the coupling of the electrical connector and the mating connector according to the embodiment is locked, FIG. 12A showing a plan view of the electrical connector, FIG. 12B showing a right side view of the electrical connector, and FIG. 12C showing a cross-sectional view of FIG. 12B viewed along the X-X arrow.
Figure 12B:
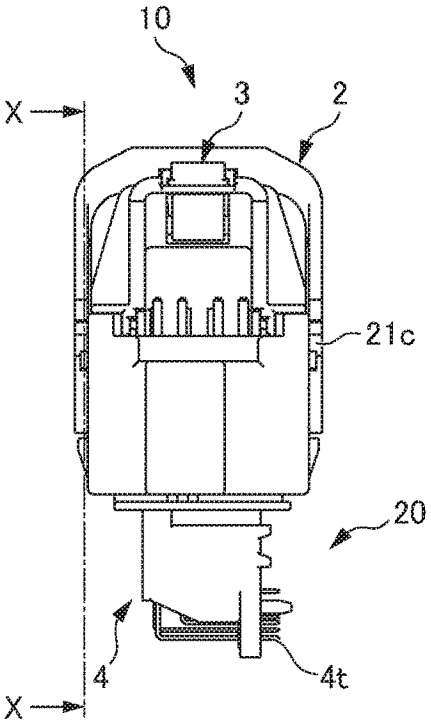
Figure 12A:
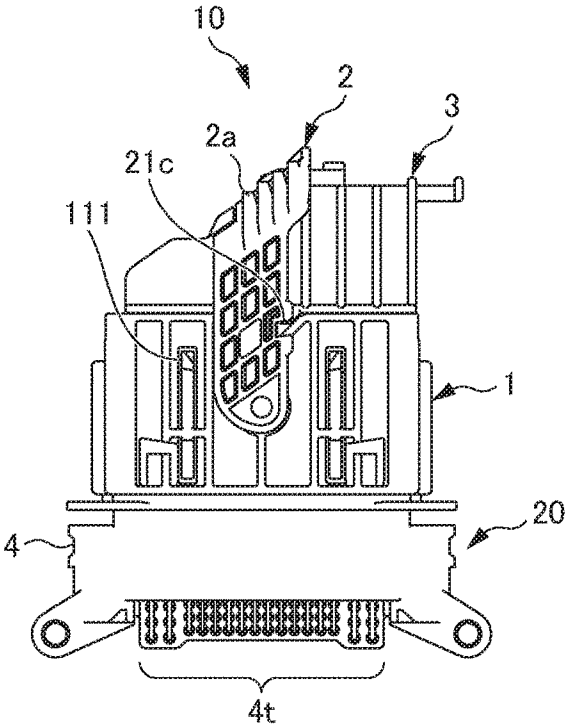

FIGS. 12A to 12C will be referenced. It is possible to lock the lance 2*r* with the locking piece 3*r* by rotating the lock lever 2 approximately 90 degrees in the one direction D1 in the state shown in FIGS. 11A to 11C. In this state, the fitting between the projections 112 and 112 and the projections 4*d* and 4*d* is strengthened since the projections 112 and 112 go beyond the projections 4*d* and 4*d*. The torsion arm also returns to its original shape, and thus, the respective projections 111 of the pair of lock arms 11 and 11 is in a state projecting from both side faces of the housing 1. This makes it possible to maintain the state of the plug 10 and the receptacle 20 being connected to each other.

According to the embodiments of the present disclosure, a cable connector that can be connected to the end of the cable (wire bundle) is disclosed, and an electrical connector in which a mating connector can be fixed on an apparatus side is disclosed. However, the electrical connector according to the present disclosure is expected to be also applied to wire-to-wire which electrically connects a cable with a cable.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. An electrical connector configured to be detachably connected to a mating connector, the electrical connector comprising:

a box-shaped housing having an opening on one face through which a mating housing the mating connector can be introduced inside;

a lock lever including at least one arm that is coupled to at least one side face of the box-shaped housing in a cantilevered manner and in such a manner that a base end of the arm is rotatable, the lock lever configured to pull the mating housing inside the box-shaped housing; and a projection that can be hidden from the side face of the box-shaped housing, the projection configured to project from at least one side face of the box-shaped housing in a state in which the mating housing is not introduced inside the box-shaped housing, and configured to be hidden from the at least one side face of the box-shaped housing in a state in which the mating housing is introduced inside the box-shaped housing, wherein the lock lever has a rectangular recess in an intermediate portion of the arm, and to which the projection can be introduced, the recess includes a first inner wall and a second inner wall formed therein which can be pressed by the projection by a rotational force of the lock lever in one direction being divided, and in a state in which the projection projects from the one side face of the box-shaped housing, the rotation of the lock lever in the one direction is prevented.

2. The electrical connector according to claim 1, wherein the lock lever is configured as a portal lock lever in which the arms are disposed opposing each other and tip ends of the arms are coupled by a grip, and the box-shaped housing has a pair of coupling portions that rotatably holds base ends of the arms on both side faces of the box-shaped housing.

3. The electrical connector according to claim 2, further comprising a cable cover that covers an opposite side of the one face of the box-shaped housing, wherein the lock lever includes a lance at the grip, and the cable cover includes a locking piece that can be locked with the lance of the grip at the top of the cable cover.

4. The electrical connector according to claim 1, wherein the lock lever includes a disk portion that projects toward an inner wall side of the box-shaped housing at the base end of the arm, and a cam groove provided at the disk portion, the mating housing includes a locking projection that projects from an outer wall of the mating housing and can approach the cam groove of the disk portion, and the cam groove of the disk portion is configured to guide the mating housing in such a manner being able to pull the mating housing to the box-shaped housing, when rotating the lock lever in one direction from a state in which the locking projection is introduced from an inlet of the cam groove.

5. The electrical connector according to claim 1, wherein the lock lever has the rectangular recess at an edge portion in the intermediate portion of the arm.

6. An electrical connector configured to be detachably connected to a mating connector, the electrical connector comprising:

a box-shaped housing having an opening on one face through which a mating housing of the mating connector can be introduced inside;

a lock lever including at least one arm that is coupled to at least one side face of the box-shaped housing in a cantilevered manner and in such a manner that a base end of the arm is rotatable, the lock lever configured to pull the mating housing inside the box-shaped housing; and a projection that can be hidden from the side face of the box-shaped housing, the projection configured to project from at least one side face of the box-shaped housing in a state in which the mating housing is not introduced inside the box-shaped housing, and configured to be hidden from the at least one side face of the box-shaped housing in a state in which the mating housing is introduced inside the box-shaped housing, wherein the lock lever has a rectangular recess at an edge portion in an intermediate portion of the arm, and to which the projection can be introduced, the recess includes a first inner wall which is a bottom wall of the recess and a second inner wall which is one side wall of the recess, formed therein which can be pressed by the projection by a rotational force of the lock lever in one direction being divided, and in a state in which the projection projects from the one side face of the box-shaped housing, the rotation of the lock lever in the one direction is prevented.

7. The electrical connector according to claim 6, wherein the lock lever is configured as a portal lock lever in which the arms are disposed opposing each other and tip ends of the arms are coupled by a grip, and the box-shaped housing has a pair of coupling portions that rotatably holds base ends of the arms on both side faces of the box-shaped housing.

8. The electrical connector according to claim 7, further comprising a cable cover that covers an opposite side of the one face of the box-shaped housing, wherein the lock lever includes a lance at the grip, and the cable cover includes a locking piece that can be locked with the lance of the grip at the top of the cable cover.

9. The electrical connector according to claim 6, wherein the lock lever includes a disk portion that projects toward an inner wall side of the box-shaped housing at the base end of the arm, and a cam groove provided at the disk portion, the mating housing includes a locking projection that projects from an outer wall of the mating housing and can approach the cam groove of the disk portion, and the cam groove of the disk portion is configured to guide the mating housing in such a manner being able to pull the mating housing to the box-shaped housing, when rotating the lock lever in one direction from a state in which the locking projection is introduced from an inlet of the cam groove.

* * * * *